US006659108B1

(12) United States Patent
Hardenbrook

(10) Patent No.: US 6,659,108 B1
(45) Date of Patent: Dec. 9, 2003

(54) HAIR CURLER

(76) Inventor: Wendy A. Hardenbrook, 4748 Freshwater Rd., Delaware, OH (US) 43015

( * ) Notice: Subject to any disclaimer, the term of this patent is extended or adjusted under 35 U.S.C. 154(b) by 0 days.

(21) Appl. No.: 10/209,226

(22) Filed: Jul. 31, 2002

(51) Int. Cl.[7] ..... A45D 6/16; A45D 2/00
(52) U.S. Cl. ..... 132/251; 132/245
(58) Field of Search ..... 132/251, 245, 132/247, 250, 253, 259, 260, 278, 273, 264

(56) References Cited

U.S. PATENT DOCUMENTS 2,179,751 A * 11/1939 McFadden ..... 132/251
2,256,143 A * 9/1941 Dunlavy ..... 132/251
2,383,612 A * 8/1945 Morton ..... 13/251
3,415,255 A * 12/1968 Heihachi Mitsumoto ... 132/251

* cited by examiner

*Primary Examiner*—John J. Wilson
*Assistant Examiner*—Robyn Kieu Doan
(74) *Attorney, Agent, or Firm*—Joseph R. Birkner

(57) ABSTRACT

A hair curler having a spool for receiving a lock of human hair for wrapping thereabout a core disposed between a rim of the spool and a clip having a first portion and a second portion joined together by a hinge, for clamping the spool and the lock of human hair together for producing a curl in the lock of human hair is disclosed. The spool and the clip of the hair curler, in combination, produces a curl in the lock of human hair when the clip is placed on, and releasably secured to the spool with the lock of human hair sandwiched therebetween the spool and the clip without the clip directly contacting the lock of human hair. The first portion and the second portion of the clip are pivotally connected together by a hinge. The first portion and the second portion being biased toward each other when in use by fabricating the clip from a flexible material which inherently allows the material to flex and to bow when the first portion and the second portion of the clip are gently urged toward each other. For releasably retaining the first portion and the second portion of the clip in engagement with each other a keeper is formed on the first portion where an apex of the second portion releasably engages the keeper. To make the invention even more useful, for aligning the clip onto the spool, the addition of a guide is disposed on the first portion of the clip about midway along a length of the first portion for engaging the spool having a bore centrally disposed therethrough so that the clip may be aligned on the spool by human feel when the guide is seated in the bore of the spool.

20 Claims, 2 Drawing Sheets

HAIR CURLER

FIELD OF THE INVENTION

This invention relates generally to hair curling. More particularly, the present invention relates to a hair curler for imparting a curl to hair for cosmetic purposes.

BACKGROUND OF THE INVENTION

The typical hair curler is a plastic cylinder around which the hair is wound about when wet. Clips and other means are provided for keeping the hair in place about the cylinder until it dries afterwhich a curl is formed. Heat or chemical agents may be applied to the hair to enhance the curl. Another type of hair curler is an electric wand-type curling iron.

A disadvantage of using traditional hair curlers such as the cylinder and clip design is that they are awkward to sleep with. Another problem is that electric waving apparatus are dangerous to use particularly with small children in the household.

A practical hair curler, for which there is an unfulfilled need, wherein the hair curler apparatus being capable of safely imparting a uniform and stylish curl in hair, and one which allows a user to comfortably sleep with the hair curler in use, is not available.

In view of the above mentioned problems and limitations associated with conventional hair waving and curler devices, it was recognized by the present inventor that there is an unfulfilled need for an improved hair curler which is simple in design, practical, fun to use and is economically manufactured and which overcomes the disadvantages of the prior art devices.

SUMMARY OF THE INVENTION

It is therefore an object of this invention to provide a new and improved hair curler which avoids the aforementioned problems of prior art devices.

It is an object of the instant invention to provide a hair curler with a combination of a spool for receiving a lock of human hair for wrapping thereabout and a clip having a first portion and a second portion, for clamping the spool and the lock of human hair together.

It is an object of the instant invention to provide a hair curler with a means for pivotally connecting the first portion and said second portion of the clip together.

It is an object of the instant invention to provide a hair curler with a biasing means disposed on the first portion and on the second portion of the clip for maintaining the first portion and the second portion of the clip biased toward each other when in use.

It is another object of the instant invention to provide a hair curler with a means for releasably retaining the first portion and the second portion of the clip in engagement with each other by the biasing means.

It is another object of the instant invention to provide a hair curler with a means for aligning the clip onto the spool.

It is another object of the instant invention to provide a hair curler which may be manufactured from readily available materials by conventional manufacturing processes.

It is still another object of the instant invention to provide a hair curler which allows a user to be able to comfortably sleep with the hair curler in use.

It is a further object of this invention to provide a hair curler that is simple in design, simple to manufacture, low in cost and fun to use.

Further objects will become apparent from the following description and claims.

This invention results from the realization that there is a great need for an improved hair curler. The resulting invention provides a user the capability of conveniently being able to safely and effectively style hair without the problems associated with the prior art devices.

The above and the other objects are achieved in accordance with the present invention, which, according to a first aspect, provides a hair curler which has a spool for receiving a lock of human hair for wrapping thereabout and a clip, having a first portion and a second portion, for clamping the spool and the lock of human hair together. The spool and the clip, in combination, produce a curl in the lock of human hair when the clip is placed on, and releasably secured to the spool with the lock of human hair sandwiched therebetween the spool and the clip without the clip directly contacting the lock of human hair. The first portion and the second portion of the clip have means for pivotally connecting the portions of the clip together in the form of a hinge. There are biasing means, disposed on the first portion and on the second portion of the clip for maintaining the first portion and the second portion biased toward each other when in use. The biasing means is achieved by fabricating the clip from a flexible material which inherently allows the material to flex and to bow when the first portion and the second portion of the clip are gently urged toward each other. There are also means for releasably retaining the first portion and the second portion of the clip in engagement with each other by the biasing means in the form of a keeper formed on the first portion where an apex of the second portion releasably engages the keeper.

The second aspect is a special case of the first aspect of this invention with additional features. There are means for aligning the clip onto the spool, which includes a guide disposed on the first portion of the clip about midway along a length of the first portion for engaging the spool having a bore centrally disposed therethrough so that the clip may be aligned on the spool by human feel when the guide is seated in the bore of the spool. The guide is dimensioned and sized to allow the guide to penetrate the bore of the spool an amount necessary to allow the clip to be aligned by the human feel of a user.

DETAILED DESCRIPTION OF PREFERRED EMBODIMENTS

Figure 1:
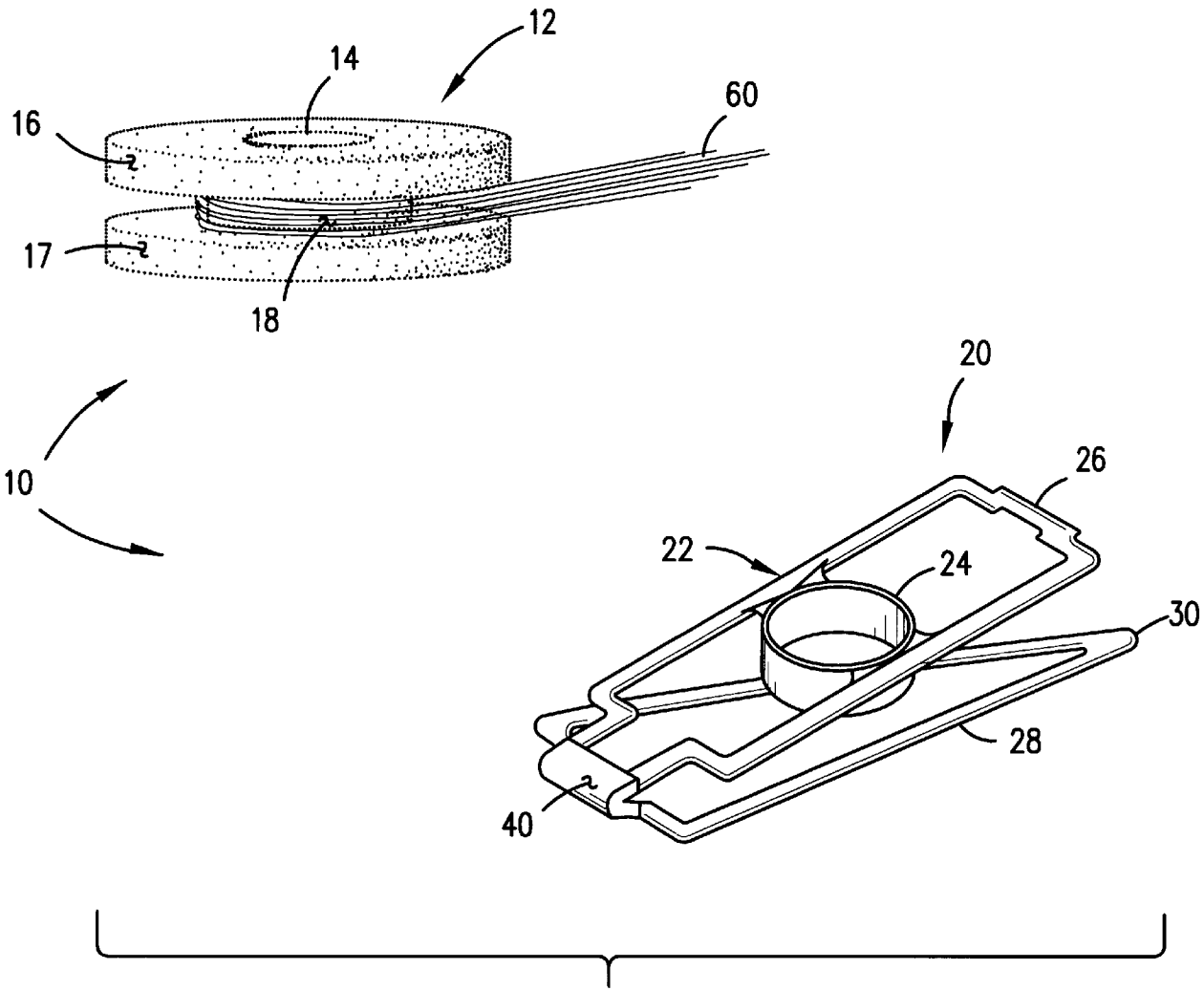
FIG. 1 is a perspective view of a preferred embodiment of a hair curler of the instant invention.

Looking more particularly to the drawings, there is shown in FIG. 1 a preferred embodiment of a hair curler which is generally indicated at 10, according to a preferred embodiment of the present invention.

FIG. 1 is a perspective view of a preferred embodiment of a hair curler 10 of the instant invention. As seen in FIG. 1, the hair curler 10, has at least two major components, a spool 12 for receiving a lock of human hair 60 for wrapping thereabout a core 18 disposed between a rim 16, 17 of the spool 12 and a clip 20 having a first portion 22 and a second portion 28 joined together by a hinge 40, for clamping the spool 12 and the lock of human hair 60 together for producing a curl in the lock of human hair 60.

The spool 12 and the clip 20 of the hair curler 10, in combination, produces a curl in the lock of human hair 60 when the clip 20 is placed on, and releasably secured to the spool 12 with the lock of human hair 60 sandwiched therebetween the spool 12 and the clip 20 without the clip 20 directly contacting the lock of human hair 60 as best seen in FIGS. 2 to 5.

The spool 12 preferably is made from a soft, pliable, compressible material such as a sponge. Although not necessary for operation, it was found that the instant invention works better with a bore 14 centrally disposed therethrough to receive a guide 24 disposed on the first portion 22 of the clip 20 so that the clip 20 can be readily blindly placed into the bore 14 of the spool 12 by human feel selectively from either side of the spool 12.

The first portion 22 of the clip 20, preferably is rectangular in shape with a keeper 26 and with the guide 24 centrally disposed within the rectangular shape of the first portion 22. The guide 24, preferably is cylindrical in shape and is sized to fit into the bore 14 in the spool 12.

The second portion 28 of the clip 20, preferably is triangular in shape as an isosceles triangle with an apex 30, for engaging the keeper 26 of the first portion 22.

Both the first portion 22 and the second portion 28 of the clip 20 cooperating with each other and each made of a flexible material so that they can bend and flex when brought together.

Figure 2:
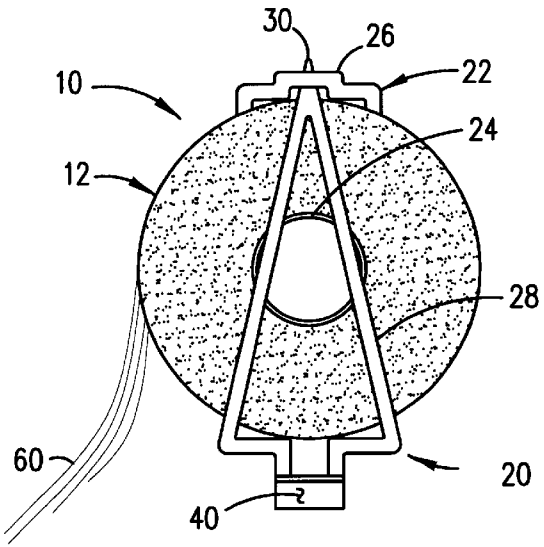
FIG. 2 is a front elevation view of the hair curler of FIG. 1 in use with a lock of human hair sandwiched between the spool and retainably clamped by a first portion and a second portion of the clip.

FIG. 2 is a front elevation view of the hair curler 10, of FIG. 1 in use with a lock of human hair 60 sandwiched between the spool 12 and retainably clamped by the first portion 22 and the second portion 28 of the clip 20 with the apex 30 of the second portion 28 engaging the keeper 26 of the first portion 22.

Figure 3:
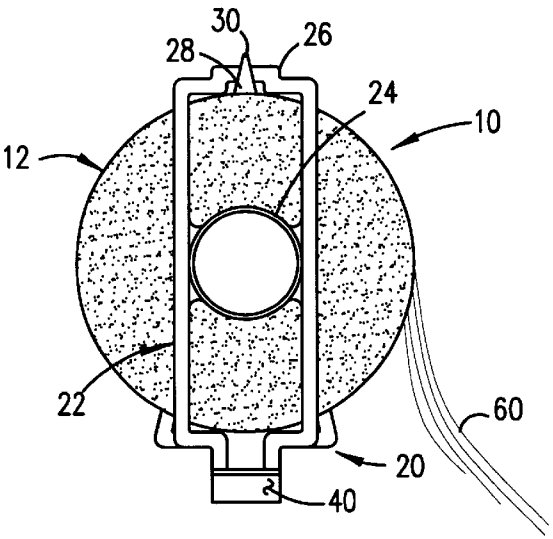
FIG. 3 is a rear elevation view of the hair curler of FIG. 2.

FIG. 3 is a rear elevation view of the hair curler 10, of FIG. 2.

Figure 4:
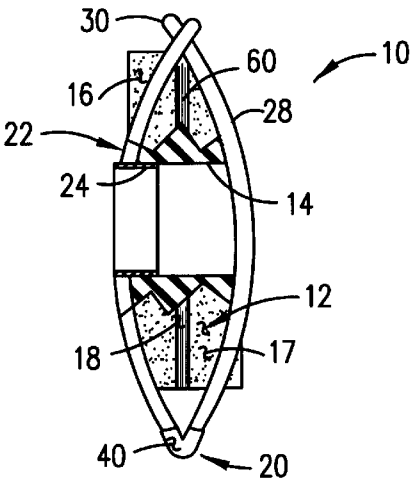
FIG. 4 is a right side elevation partial sectional view of the hair curler of FIG. 3 showing the assembly thereof.

FIG. 4 is a right side elevation partial sectional view of the hair curler 10, of FIG. 3 showing the assembly thereof. The lock of human hair 60 wrapped on the core 18 of the spool 12 is compressed a sufficient amount by the spool 12 and clip 20 assembly to impart a curl.

Figure 5:
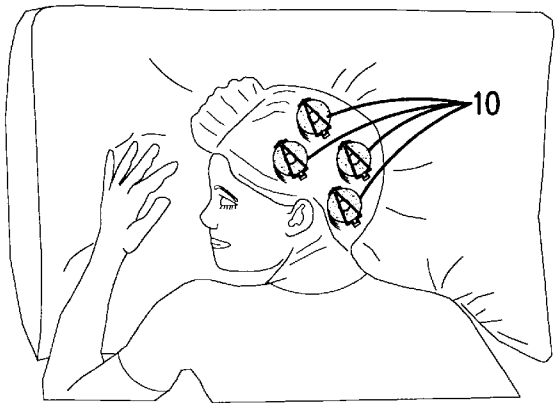
FIG. 5 is a front elevation view showing the instant invention of FIG. 1 in use.

FIG. 5 is a front elevation view showing the instant invention of FIG. 1 in use.

The hair curler 10 may be fabricated from readily available materials and by conventional fabrication techniques such as by molding. For example, the clip 20 of the hair curler 10, may be made, from a flexible material chosen from the group consisting of plastic and rubber. The clip 20, including the hinge 40 may be economically fabricated from a single cavity mold. The spool 12 may be fabricated by die cutting. The basic component parts, namely, the spool 12 and the clip 20 are readily combined and assembled to define the hair curler 10.

To use the hair curler 10, when the guide 24 of the clip 20, preferably, is provided, the lock of human hair 60 from the head of a user is wound about the core 18 of spool 12. The guide 24, of the clip 20 is placed into the bore 14, by feel, in the spool 12, and then the clip 20 is gently urged into a bowed position as seen in FIG. 4, so that the apex 30 of the second portion 28 which preferably is triangular shaped may be removably, yet positively secured to the keeper 26 of the first portion 22, as best seen in FIGS. 2 and 3, which preferably is rectangular in shape, of the clip 20 thereby sandwiching the lock of human hair 60 therebetween the spool 12 and the clip 20 for a time sufficient enough to impart a curl in the hair when the hair curler 10 is removed by reversing the procedure. The hair curler 10 permits a user to sleep on a pillow with a head fall of hair curlers 10 as shown in FIG. 5 without discomfort or interference as is a common disadvantage associated with traditional roller type hair curlers. When the guide 24 is not provided on the hair curler 10, the clip 20 is simply placed onto the spool 12 with the lock of human hair therebetween.

The combination of the spool 12 and the clip 20 including the pivotally connecting means, such as the hinge 40 in combination with the biasing means of the clip 20 being of a flexible material, and the means for releasably retaining the first portion 22 and the second portion 28 of the clip 20 in engagement with each other by the biasing means in the form of a keeper 26 where an apex 30 of the second portion 28 releasably engages the keeper 26, cooperatively contribute to a high quality curl in the lock of human hair 60. Furthermore, the means for aligning the clip 20 onto the spool 12 including the guide 26 disposed on said first portion 22 of the clip 20 and the bore 14 of the spool 12 further adds to the synergistic effect and novelty of the invention whereby the invention as a whole, is greater than the sum of the individual component parts. For example, the applicant has actually reduced the instant invention shown herein to practice. The applicant has, according to the teachings herein, actually constructed and successfully tested, with favorable hair curl producing results, a fully functional prototype hair curler 10 as shown in FIGS. 1 to 5.

Surprisingly, the instant invention provides an added advantage and recognizes a problem of a need for improved hair curling and adequately and completely addresses an unfulfilled need, in that the hair curler 10, in the manner disclosed, in effect, provides a convenient apparatus which allows a user to blindly style hair by feel when a guide 24 is used. Also, by having the bore 14 pass completely through spool 12 allows the guide 24 to be placed on either side of the spool 12 without having to pay close attention to orientation which facilitates use. Also, the hair curler 10, as disclosed, allows a user to sleep with the hair curler 10 in place without discomfort and provides the desired above mentioned advantages and benefits to a user. Furthermore, the use a sponge-like material for the spool 12, provides an added benefit in that the sponge-like material absorbs moisture from wet hair by wicking which accelerates drying of the hair.

It is understood that the hair curler 10 may be constructed in a wide variety of sizes, colors and style variations. One practical advantage of the invention is that it provides a convenient, practical, low cost, hair curler 10, which allows a user to conveniently impart a stylish wave in the lock of human hair 60. A further advantage of the invention is that the hair curler 10 is designed for ease of manufacture by standard methods and by using readily available materials.

Of course, a wide variety of further uses and advantages of the present invention will become apparent to one skilled in the art. Also, one skilled in the art will realize that the foregoing discussion outlines the more important features of the invention to enable a better understanding of the instant invention and to instill a better appreciation of the inventor's contribution to the art. It must be clear that the disclosed details of construction, descriptions of geometry and illustrations of inventive concepts are mere examples of possible manifestations of the invention.

Although the invention has been shown and described with reference to certain preferred embodiments, those skilled in the art undoubtedly will find alternative embodiments obvious after reading this disclosure. With this in mind, the following claims are intended to define the scope of protection to be afforded the inventor, and those claims shall be deemed to include equivalent constructions insofar as they do not depart from the spirit and scope of the present invention.

What is claimed:

1. A hair curler comprising:

a spool for receiving a lock of human hair for wrapping thereabout;

a clip, having a first portion and a second portion, for clamping said spool and the lock of human hair together;

said spool and said clip, in combination, for producing a curl in the lock of human hair when said clip is placed on, and releasably secured to said spool with the lock of human hair sandwiched therebetween said spool and said clip without said clip directly contacting the lock of human hair;

means for pivotally connecting said first portion and said second portion of said clip together;

biasing means for maintaining said first portion and said second portion of said clip biased toward each other when in use disposed on said first portion and on said second portion of said clip; and means for releasably retaining said first portion and said second portion of said clip in engagement with each other by said biasing means.

2. The hair curler of claim 1 wherein said means for pivotally connecting said first portion and said second portion of said clip together is a hinge.

3. The hair curler of claim 2 wherein said biasing means for maintaining said first portion and said second portion of said clip biased toward each other when in use is achieved by fabricating said clip from a flexible material which inherently allows the material to flex and to bow when said first portion and said second portion of said clip are gently urged toward each other.

4. The hair curler of claim 3 wherein said means for releasably retaining said first portion and said second portion of said clip in engagement with each other by said biasing means includes a keeper formed on said first portion where an apex of said second portion releasably engages said keeper.

5. The hair curler of claim 4 further comprising means for aligning said clip onto said spool.

6. The hair curler of claim 5 wherein said means for aligning said clip onto said spool includes a guide disposed on said first portion of said clip about midway along a length of said first portion for engaging said spool having a bore centrally disposed therethrough so that said clip may be aligned on said spool by human feel when said guide is seated in the bore of said spool.

7. The hair curler of claim 6 wherein said guide is dimensioned and sized to allow said guide to penetrate the bore of said spool an amount necessary to allow said clip to be aligned by the human feel of a user.

8. The hair curler of claim 7 wherein said first portion of said clip is rectangular in shape and said second portion of said clip is triangular in shape.

9. The hair curler of claim 8 wherein said clip is fabricated from a material chosen from the group consisting of plastic and rubber.

10. The hair curler of claim 9 wherein said spool is fabricated from a soft, cushioning, compressible, sponge-like material so that a user may sleep with said hair curler in place without discomfort.

11. The hair curler of claim 10 wherein said clip is fabricated by molding and said spool is fabricated by die cutting.

12. A hair curler comprising:

a spool for receiving a lock of human hair for wrapping thereabout a core between a rim of said spool, said spool having a bore centrally disposed therethrough and a clip having a first portion and a second portion for clamping said spool and the lock of human hair together;

said spool and said clip, in combination, for producing a curl in the lock of human hair when said clip is placed on, and releasably secured to said spool with the lock of human hair sandwiched therebetween said spool and said clip for a sufficient time and without said clip directly contacting the lock of human hair;

said first portion of said clip having a guide positioned about midway along a length of said first portion for engaging the bore of said spool so that said clip may be aligned on said spool by human feel when said guide is seated in the bore of said spool;

said second portion of said clip for engaging said first portion of said clip when said spool and said clip are cooperatively joined together;

said first portion and said second portion of said clip pivotally connected by a hinge;

biasing means for maintaining said first portion and said second portion of said clip biased toward each other when in use disposed on said first portion and on said second portion of said clip; and means for releasably retaining said first portion and said second portion of said clip in engagement with each other by said biasing means.

13. The hair curler of claim 12 wherein said guide is cylindrical in shape and having a length and size sufficient enough to allow said guide to penetrate the bore of said spool an amount necessary to allow said clip to be aligned by the human feel of a user.

14. The hair curler of claim 13 wherein said biasing means for maintaining said first portion and said second portion of said clip biased toward each other when in use is achieved by fabricating said clip from a flexible material which inherently allows the material to flex and to bow when said first portion and said second portion of said clip are gently urged toward each other.

15. The hair curler of claim 14 wherein said means for releasably retaining said first portion and said second portion of said clip in engagement with each other by said biasing means includes a keeper formed on said first portion where an apex of said second portion releasably engages said keeper.

16. The hair curler of claim 15 wherein said first portion of said clip is rectangular in shape and said second portion of said clip is triangular in shape.

17. The hair curler of claim 16 wherein said clip is fabricated from a material chosen from the group consisting of plastic and rubber.

18. The hair curler of claim 17 wherein said spool is fabricated from a soft, cushioning, compressible, sponge-like material so that a user may sleep with said hair curler in place without discomfort.

19. The hair curler of claim 18 wherein said clip is fabricated by molding and said spool is fabricated by die cutting.

20. A hair curler comprising:

a spool for receiving a lock of human hair for wrapping thereabout a core of said spool, and a clip having a first portion and a second portion pivotally connected together by a hinge for clamping said spool and the lock of human hair together, in combination, for producing a curl in the lock of human hair when said clip is placed on, and releasably secured to said spool with the lock of human hair sandwiched therebetween said spool and said clip for a sufficient time and without said clip directly contacting the lock of human hair;

said spool having a bore centrally disposed therethrough and said spool fabricated from a soft, cushioning, compressible, sponge-like material so that a user may sleep with said hair curler in place without discomfort;

said clip fabricated from a flexible material chosen from the group consisting of plastic and rubber which inherently allows the chosen material to flex and to bow when said first portion and said second portion of said clip are gently urged toward each other;

said first portion and said second portion of said clip releasably retained in engagement with each other with a keeper formed on said first portion where an apex of said second portion releasably engages said keeper; and said first portion of said clip having a guide positioned about midway along a length of said first portion for engaging the bore of said spool so that said clip may be blindly aligned on said spool by human feel when said guide is seated in the bore of said spool.

* * * * *